US006022242A

United States Patent [19]

Suzuki

[11] Patent Number: 6,022,242

[45] Date of Patent: Feb. 8, 2000

[54] CONNECTOR USED FOR FLEXIBLE FLAT CABLE

[75] Inventor: Masao Suzuki, Tokyo, Japan

[73] Assignee: Thomas & Betts International, Inc., Sparks, Nev.

[21] Appl. No.: 09/074,746

[22] Filed: May 8, 1998

[30] Foreign Application Priority Data

Sep. 5, 1997 [JP] Japan ..... 9-119544

[51] Int. Cl.[7] ..... H01R 9/07

[52] U.S. Cl. ..... 439/495; 439/67

[58] Field of Search ..... 439/495, 493, 439/67, 331

[56] References Cited

U.S. PATENT DOCUMENTS

| | | | |
|---|---|---|---|
| 3,082,398 | 3/1963 | Valach | 339/176 |
| 3,084,302 | 4/1963 | Braeutigam | 339/17 |
| 3,114,587 | 12/1963 | Herrmann | 339/75 |
| 3,278,887 | 10/1966 | Travis | 339/176 |
| 3,319,216 | 5/1967 | McCullough | 339/176 |
| 3,393,392 | 7/1968 | Shelley | 339/17 |
| 3,486,159 | 12/1969 | Matthews | 339/17 |
| 3,486,216 | 12/1969 | Cimolino | 29/427 |
| 3,696,319 | 10/1972 | Olsson | 339/17 F |
| 3,772,775 | 11/1973 | Bonnke et al. | 29/628 |
| 3,897,130 | 7/1975 | Donnelly et al. | 339/176 MF |
| 4,235,500 | 11/1980 | Belopavlovich et al. | 339/176 MF |
| 4,265,507 | 5/1981 | Johnson | 339/176 MF |
| 4,379,608 | 4/1983 | Olsson et al. | 339/75 MP |
| 4,422,700 | 12/1983 | Krenz | 339/14 R |
| 4,573,752 | 3/1986 | Rich | 339/17 F |
| 4,639,063 | 1/1987 | Mueller | 339/75 M |
| 4,681,382 | 7/1987 | Lockard | 439/92 |
| 4,684,183 | 8/1987 | Kinoshita et al. | 439/77 |
| 4,750,881 | 6/1988 | Kikuchi et al. | 400/352 |
| 4,824,391 | 4/1989 | Ii | 439/329 |
| 4,938,702 | 7/1990 | English | 439/67 |
| 4,944,690 | 7/1990 | Imai | 439/492 |
| 4,971,575 | 11/1990 | Martellotti | 439/496 |
| 5,030,794 | 7/1991 | Schell et al. | 174/36 |
| 5,044,980 | 9/1991 | Krumme et al. | 439/496 |
| 5,097,099 | 3/1992 | Miller et al. | 174/36 |
| 5,209,671 | 5/1993 | Sugimoto et al. | 439/67 |
| 5,262,590 | 11/1993 | Lia | 174/36 |
| 5,297,968 | 3/1994 | Johnson et al. | 439/67 |
| 5,383,788 | 1/1995 | Spencer | 439/67 |
| 5,397,247 | 3/1995 | Aoki et al. | 439/496 |
| 5,403,202 | 4/1995 | Roehling | 439/493 |
| 5,428,187 | 6/1995 | Crane et al. | 174/36 |
| 5,433,632 | 7/1995 | Cherney et al. | 439/495 |
| 5,507,651 | 4/1996 | Tanaka et al. | 439/67 |
| 5,529,502 | 6/1996 | Peltier et al. | 439/67 |
| 5,616,050 | 4/1997 | Suski | 439/495 |

FOREIGN PATENT DOCUMENTS

| | | |
|---|---|---|
| 49-8168 | 1/1974 | Japan . |
| 60-109280 | 7/1985 | Japan . |
| 3-29280 | 2/1991 | Japan . |
| 6-68940 | 3/1994 | Japan . |
| 6-88083 | 3/1994 | Japan . |
| 8-203626 | 2/1996 | Japan . |

*Primary Examiner*—Renee S. Luebke
*Assistant Examiner*—Javaid Nasri
*Attorney, Agent, or Firm*—Hoffman & Baron, LLP

[57] ABSTRACT

A connector used for a flexible flat cable, comprises: a housing having a plurality of contacts mounted therein, and a cap plate for capping and retaining a flexible flat cable set in the housing. The housing includes an opening for receiving the flexible flat cable and a recess formed substantially in the center of the opening in the longitudinal direction of the housing. Contact portions of contacts extend to the recess, and are mounted along the long side of the housing at a predetermined pitch.

3 Claims, 4 Drawing Sheets

CONNECTOR USED FOR FLEXIBLE FLAT CABLE

FIELD OF THE INVENTION

The present invention relates to a small connector used for connecting a flexible flat cable to a printed circuit board (especially a flexible board), and in particular to a low-profile small connector on which multiple contacts are mounted at a short arrangement pitch.

BACKGROUND OF THE INVENTION

An example of a flexible flat cable (including a flexible printed circuit (called an FPC) cable) is a ZIF (zero insertion force)-FPC connector or a connector disclosed in Utility Model Laid-open Japanese Publication 6-88083 (1994).

For the first connector, after the attachment of a cable a lever must be rotated in order for a cable electrode (or a conductive contact) to make contact with the contact of the connector, and special equipment is required to automate the job of assembling the cable and the connector.

To eliminate the above problem, according to a method employed for the second connector, whereby a reinforcement plate (a cover) is attached to the surface of a cable and the cable with the reinforcement plate is directly assembled with the connector, the reinforcement plate engages a guide formed on the connector during the assembly of the cable and the connector to thereby position the cable correctly.

However, a process for attaching the reinforcement plate to the surface of the cable can be required before the cable is assembled with the connector, and high accuracy is required for the attachment, especially for a connector whose contacts are arranged at a short pitch, so that strict control of the sizes of the parts must be exercised.

SUMMARY OF THE INVENTION

A connector according to the present invention has been developed in order to eliminate the above problems of the conventional connector.

Specifically, it is one object of the present invention to provide a flexible flat cable connector that has multiple contacts arranged at short pitches, and for which the exertion of the retention force requires only a simple operation, while taking into account the automation of the assembly of the cable and the connector.

To achieve the above object, according to the present invention, there is provided a connector used for a flexible flat cable comprising a housing having a plurality of contacts mounted therein, and a cap plate for capping and retaining a flexible flat cable set in the housing, wherein the housing includes an opening for receiving the flexible flat cable and a recess formed substantially in the center of the opening in the longitudinal direction of the housing, and each of the plurality of the contacts comprises a contact portion extending into the recess and a leg portion extending externally, the contacts being mounted at a predetermined pitch in the longitudinal direction of the housing, wherein the cap plate caps and holds the flexible flat cable inserted through the opening in the housing, and brings conductive contact portions of the flexible flat cable into contact with corresponding contacts in the housing to establish electrical connections, and wherein the housing and the cap plate have latching means for latching means for latching them to retain the flexible flat cable positioned in the housing.

BRIEF DESCRIPTIONS OF THE DRAWINGS

DETAILED DESCRIPTION OF THE INVENTION

The arrangement of the present invention will now be described by referring to one illustrated embodiment.

Figure 1:
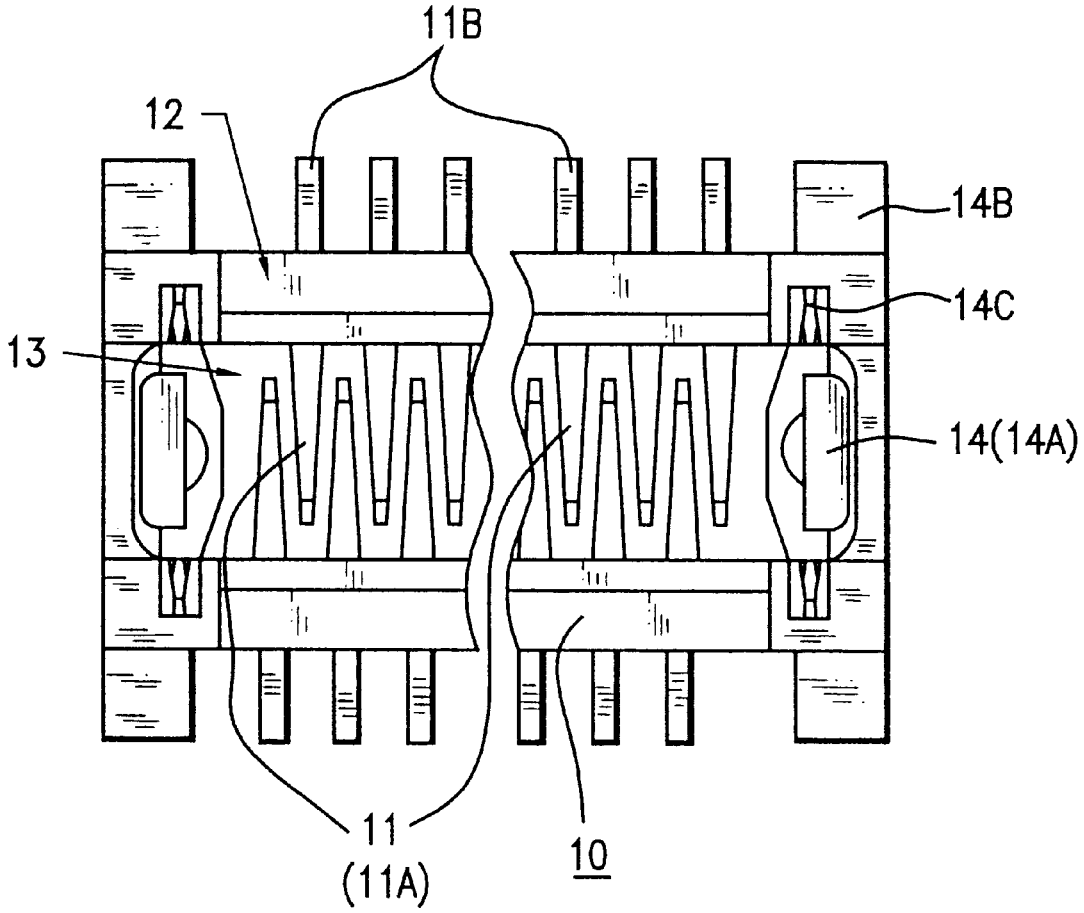
FIG. 1 is a plan view showing a connector according to the present invention.
Figure 2:
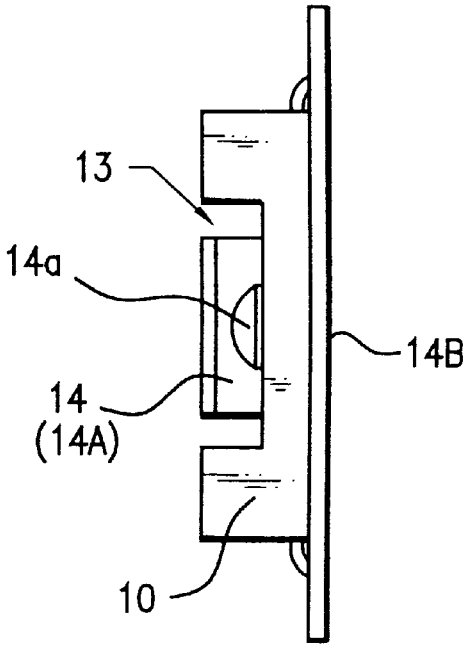
FIG. 2 is a side view showing the connector shown in FIG. 1.
Figure 3:
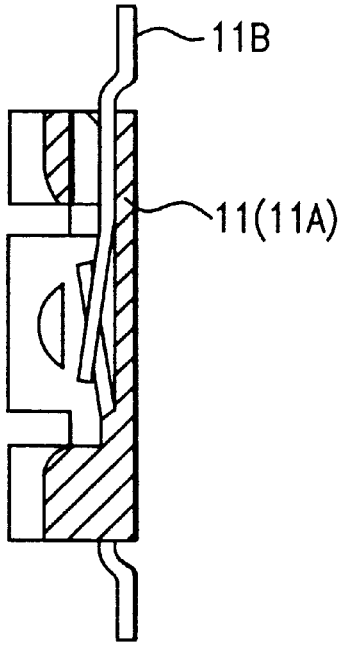
FIG. 3 is a sectional view showing the connector shown in FIG. 1.
Figure 4:
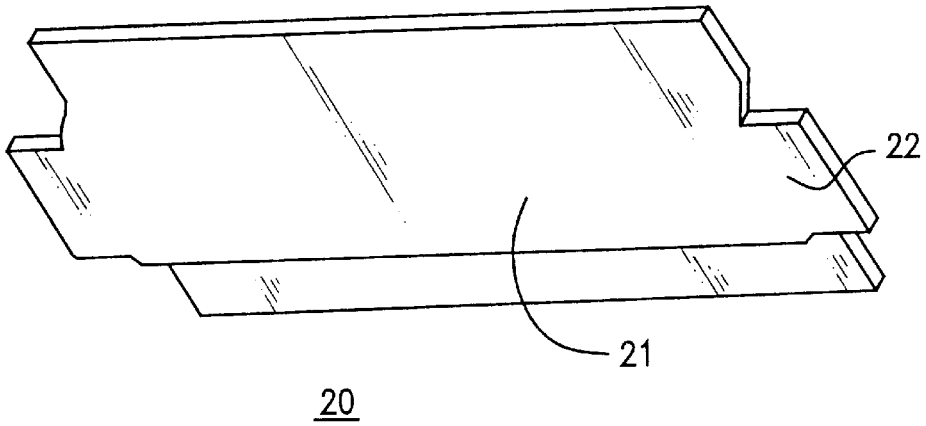
FIG. 4 is a perspective view showing a cover plate of the connector according to the present invention.

A connector according to the present invention, which is used for flexible flat cable, comprises a housing 10 on which a plurality of contacts 11 are mounted; and a cap plate 20 for capping and retaining a flexible flat cable 100 that is positioned in the housing. In FIGS. 1 to 3 is shown the housing of the connector of the present invention, and in FIG. 4 is shown the cap plate.

The external shape of the entire housing is a rectangular, and provided in the housing are an opening 12 for accepting and positioning the flexible flat cable, and a recess 13 formed substantially in the center of the opening and extending in the longitudinal direction of the housing (the ridge (protrusion) of the cap plate engages the recess with the cable positioned in between, as will be described later).

The contacts are arranged at a constant pitch at the bottom of the opening in the housing and along the long sides of the housing that face each other. At this time, contact portions 11A of the contacts extend inside the recess in the housing, leg portions 11B of the contacts extend outward, and the main body between the contact portions and the leg portions of the contacts is securely fixed or embedded in grooves formed in the facing sides of the housing. In this embodiment, the contact portions of the contacts are leaf springs, which alternately project into the recess from the sides of the housing located opposite each other.

Figure 5:
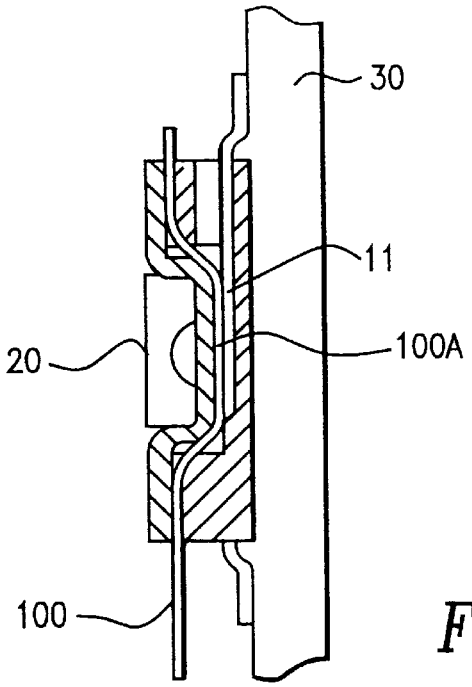
FIG. 5 Is a sectional view showing a state of the connector being used.

The cap plate caps and holds the flexible flat cable, which is inserted into the opening in the housing, and brings conductive contact portions 100A of the flexible flat cable into contact with the corresponding contacts in the housing to provide electrical connections (see FIG. 5). At this time, if the contact portions of the contacts, which are mounted on the housing, are sufficiently wide and cover the contact positions of the conductive contact portions of the flexible flat cable, precisely aligned electrical connections of the contacts and the contact portions of the cable can be obtained.

The housing and the cap plate have latching means for latching them to each other, and when the two are latched, they are positioned in the housing that they hold the flexible flat cable. In the embodiment shown in the diagrams, the latching means comprises paired protrusions 22, which, as is shown in FIG. 4, are formed along the short sides of the cap plate that face each other, and paired latch plates 14, which, as is shown in FIGS. 1 to 3, are mounted on the short sides of the housing that face each other.

The latch plates each include a latch portion 14A, latch portions 14C (see FIG. 1) and a base portion 14B (see FIGS. 1 and 2), with the first two portions being raised from the base portion. Both ends of the base portion 14B of the latch plate extend outside the housing, and are soldered, with the legs of the contacts, to conductive pads 31 (see FIG. 6) on a printed board 30 (see FIG. 5), for example. Grooves 14*a* are formed in the latch portions of the latch plate to engage the protrusions 22 on the cap plate. The latch portions 14C on the latch plate are fixed to the grooves that are formed in the short sides of the housing that face each other.

A ridge 21 is formed on the cap plate in its longitudinal direction, and is fitted into the recess in the housing when the housing engages the cap plate.

Figure 6:
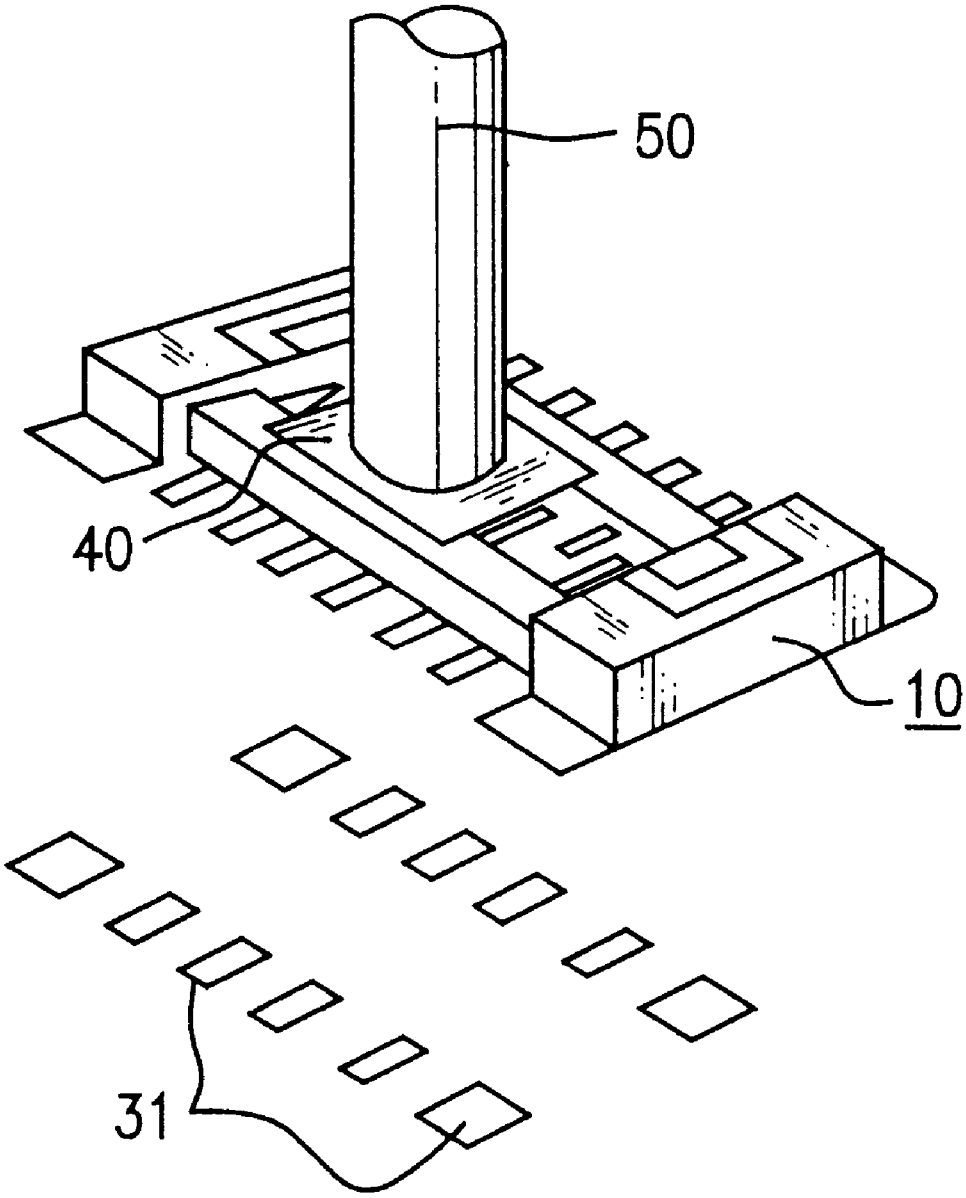
FIG. 6 is a view showing a case where the connector shown in FIG. 1 is mounted on a printed circuit board.

In FIG. 6 is shown a case where the flexible flat cable connector according to the present invention is automatically mounted on a flexible printed board. As is shown, in this embodiment, an automated mounting apparatus holds and moves the housing of the connector by using a tape 40 attached to the surface of the housing.

According to the connector of the present invention, since the cap plate caps and holds the flexible flat cable inserted into the opening in the housing (especially the ridge (the protrusion) formed on the cap plate that engages the recess in the housing via the cable), unlike the conventional connector, the process for attaching a reinforcement plate (cover plate) to the surface of the cable is not required. In addition, the accuracy of the positioning of the cable is not affected by the precision of the attachment of the reinforcement plate, and the engagement of the cover plate with the recess in the housing can correctly position the cable.

Furthermore, when the ridge of the cap plate engages the recess in the housing via a cable, the force available for holding the cable and the strength of the connector can be increased, when compared with the conventional connector where the flat cover simply engages the housing. In addition, the thickness (the height) of the connector can be adequately reduced.

Various changes to the foregoing described and shown structures would now be evident to those skilled in the art. Accordingly, the particularly disclosed scope of the invention is set forth in the following claims.

What is claimed is:

1. A connector used for a flexible flat cable, comprising:

a housing having a plurality of contacts mounted therein, and a cap plate for capping and holding said flexible flat cable set in said housing, wherein said housing includes an opening for receiving the flexible flat cable and a recess formed in a substantially center portion of the opening along a longitudinal direction of the housing, and each of said plurality of contacts comprises a contact portion extended into the recess and a leg portion extended externally, said contacts being mounted at a predetermined pitch in the longitudinal direction of the housing, wherein said cap plate caps and holds the flexible flat cable received through the opening of said housing and causes conductive contact portions of said flat cable to make electric connection, and wherein said housing and said cap plate have latching means for latching them to hold the flexible flat cable in said housing, said latching means comprising a pair of outwardly projecting protrusions formed at opposed short sides of said cap plate and a pair of latch plates formed at opposed short sides of said housing, wherein the latch plates each include a groove for engaging with the protrusions of said cap plate.

2. The connector according to claim 1, wherein said cap plate comprises a ridge formed in a longitudinal direction thereof, said ridge being fitted in the recess of said housing when said housing and said cap plate are latched.

3. The connector according to claim 1, wherein the contact portion of each of the contacts mounted in said housing sufficiently covers contact positions of conductive contact portions of the flexible flat cable.

* * * * *